United States Patent [19]

Folkesson

[11] Patent Number: 4,881,888

[45] Date of Patent: Nov. 21, 1989

[54] PRESS FOR THE CONTINUOUS PRODUCTION OF BOARDS

[76] Inventor: Bo Folkesson, Hasslegatan 33, S-542 32 Mariestad, Sweden

[21] Appl. No.: 242,576

[22] Filed: Sep. 12, 1988

[51] Int. Cl.[4] ..... B30B 5/04

[52] U.S. Cl. ..... 425/371; 100/151; 264/280; 425/363

[58] Field of Search ..... 425/363, 364, 371, 372, 425/115, 818; 264/119, 280, 320; 100/151, 152, 153

[56] References Cited

U.S. PATENT DOCUMENTS

| | | | |
|---|---|---|---|
| 2,075,735 | 3/1937 | Loomis | 425/371 |
| 3,795,470 | 3/1974 | De Mets | 425/371 |
| 3,885,901 | 5/1975 | Reiners | 425/371 |
| 3,926,542 | 12/1975 | Ahrweiler | 425/174.4 |
| 4,410,474 | 10/1983 | Ahrweiler | 264/109 |
| 4,449,448 | 5/1984 | Stäbler et al. | 100/153 |
| 4,621,999 | 11/1986 | Gerhardt | 425/371 |
| 4,642,153 | 2/1987 | Lohr | 159/296 |
| 4,771,683 | 9/1988 | Schermutzki | 100/93 P |

FOREIGN PATENT DOCUMENTS

| | | | |
|---|---|---|---|
| 0170953 | 2/1986 | European Pat. Off. | 425/371 |
| 2114010 | 10/1971 | Fed. Rep. of Germany | 100/151 |
| 2222419 | 11/1972 | Fed. Rep. of Germany | 100/151 |
| 3126739 | 1/1983 | Fed. Rep. of Germany . | |
| 3343981A1 | 6/1985 | Fed. Rep. of Germany | 425/371 |
| 61146 | 4/1982 | Finland . | |

*Primary Examiner*—Jay H. Woo
*Assistant Examiner*—Khanh P. Nguyen
*Attorney, Agent, or Firm*—Sughrue, Mion, Zinn, Macpeak and Seas

[57] ABSTRACT

In a press for the continuous production of boards according to the invention passages (11) are provided between the press belts (1) of the press and the supporting surfaces (10) thereof, said passages being completely filled with bearing balls and merging into return passages (12) so that the balls may carry out complete orbital motions.

6 Claims, 1 Drawing Sheet

PRESS FOR THE CONTINUOUS PRODUCTION OF BOARDS

BACKGROUND OF THE INVENTION

The present inventions relates to a press which operates continuously to produce boards and wherein the material to be pressed is fed into a press slot between two movable surfaces of which at least one is defined by an endless belt, preferably of steel, which at the press slot is supported by a supporting surface in such a manner that it cannot increase its distance from the opposed moving surface.

The press herein is a press by means of which boards, such as particle boards, plywood boards, fiber boards and the like, may be pressed and various kinds of boards may be laminated and provided with a surface layer. In all such cases the boards or the board blanks must be subjected to pressure. The boards or the board blanks may constitute an endless web or constitute pieces of finite length and fed into the press one after the other.

In order to obtain, for boards of the kind indicated, a more flexible and simpler method of manufacture and processing, proposals have been made to replace the conventional multiple opening presses by continuously operating presses. The invention relates to such a continuously operating press.

If the press belt slides against a supporting surface there will be friction between the surface of the press belt and the supporting surface and such friction will brake the movement of the belt and generate therein a significant tensile stress and hence considerably limit the compression pressure. To a certain extent successful efforts have been made to reduce such friction by pumping an oil or air film between the belt and the supporting surface, but this entails considerable sealing problems and allows of not interspaces between the boards or width variations. A technically better solution has been obtained by introducing a number of roller chains between the belt and the supporting surface, such chains, like roller bearings, reducing the friction between the belt and the supporting surface to a minimum. The disadvantage of the last-mentioned solution primarily is that the roller bearings or roller rods must be specially made and require extremely high precision leading to very high manufacturing costs. Also, the guiding of the press belt and the rollers or roller rods will require sensitive and costly extra equipment.

SUMMARY OF THE INVENTION

The present invention has for its purpose the improvement and simplification and hence the reduction of the costs of the last-mentioned type of continuously operating presses, and features the provision of endless passages filled with recirculating ball bearings over which the press belts ride.

BRIEF DESCRIPTION OF THE DRAWINGS

An embodiment of the invention will be described below with reference to the attached drawing, wherein.

DETAILED DESCRIPTION OF THE PREFERRED EMBODIMENT

Figure 1:
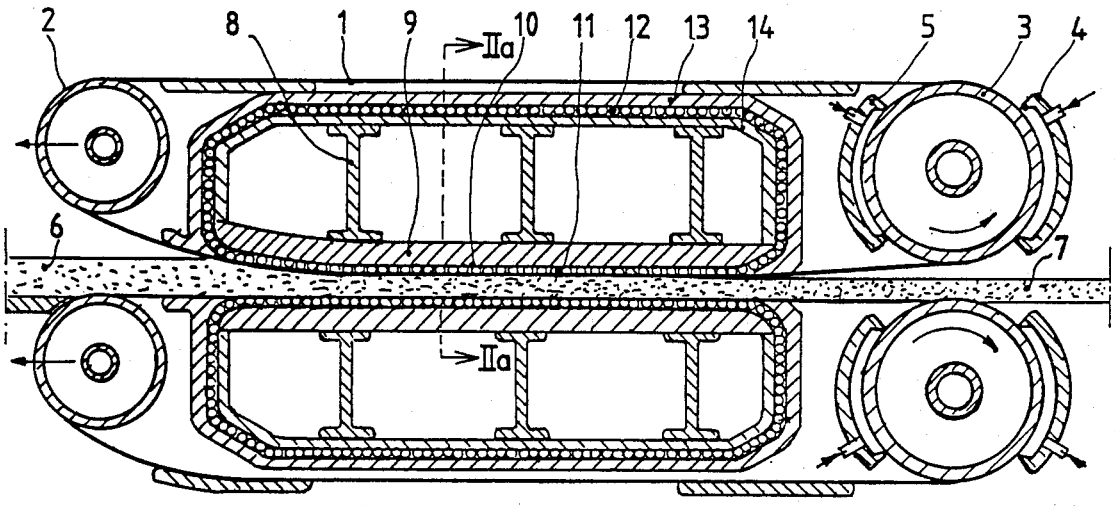
FIG. 1 illustrates a press according to the invention in vertical longitudinal section.

The press shown by the drawings consists of two endless steel belts 1 which define a press slot therebetween. The belts 1 move about end rollers 2 and 3. The end rollers 3 shown to the right in FIG. 1 are driven and both rotate at the same rate. To prevent the belts from sliding with respect to end rollers 3 the belts are pressed against the rollers by means of pressure chambers 4. To offset the pressure force on the rollers and the bearings thereof caused thereby pressure chambers 5 of the same size are provided on opposite sides of rollers 3. Another method of obtaining sufficient friction force between the belts and the driven rollers consists in very forcefully stretching the belts between rollers 2 and 3, but this entails certain disadvantages, such as large bearing loads, larger rollers 2, a larger belt tension and increased difficulties in guiding the belts.

The board material to be pressed in the example shown consists of a particle mat 6 which is fed into the press slot between press belts 1. The mat emerges from the slot in the shape of finished particle board material 1. At the press slot, the press power is transferred to press plates 9 and thence to upper and lower press beams 8 which are interconnected on the press sides. The upper press portion may be elevated or lowered by means of screws, wedges or by hydraulic means for obtaining the intended height for the press slot between the press belts 1.

To avoid friction between belts 1 and the surfaces 10 supporting the belts of press plates 9 there is, between the belts and the surfaces, a passage 11 which is filled with bearing balls. Following the press slot with respect to the direction of transport, passage 11 merges into a return passage 12 between spacer plates 13 and 14, the mutual spacing of which is somewhat larger than the diameter of the balls. Return passage 12 is also completely filled with balls and forms with passage 11 an endless passage filled with balls. In the operation of the press the balls circulate along endless paths at half the rate of press belts 1.

To prevent, in the upper press portion, the steel belt loaded by the balls from falling down on account of gravity when the press is empty or only partly filled with board material, passages 11, 12 at their lateral edges are contiguous to ducts 17 which are connected to a source of negative pressure. As is evident from FIG. 2*a* and 2*b* duct 17 at return passage 12 is defined by U-section members 15 and at the press slot by section members 18. The latter also define the width of ball passage 11 and additionally exhibit a duct 21 which is conncted to a blower with a filter which effectively prevents foreign matter from penetrating into sub-pressure duct 17 and into ball passage 11. By means of seals 19 and 20 section members 18 are sealed against steel belt 1. The lower press portion preferably also is provided with the corresponding equipment 15, 17, 18, 19 and 20 to stabilize the steel belt and to prevent foreign matter from entering ball passages 11 and 12.

Figure 2A:
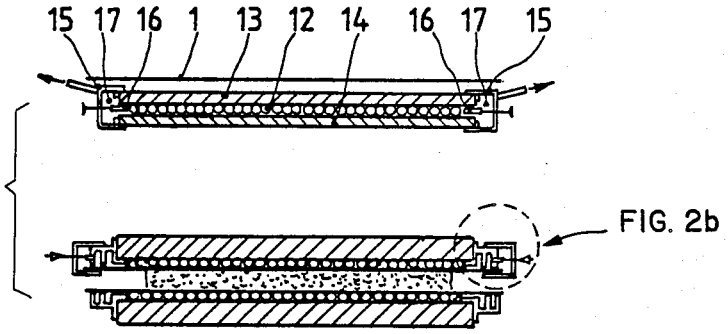
FIG. 2*a* is a section in plane II—II in FIG. 1.
Figure 2B:
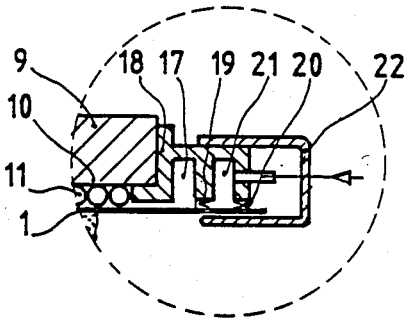
FIG. 2*b* is an exploded view of a portion of FIG. 2*a*.

As is also evident from FIG. 2*a* and 2*b* the width of return passage 12 is defined by lateral rails 16 which control ball passage 12 by means of screws and/or springs to keep it filled with balls to its maximum capacity.

If the press is empty or only partially filled with board material and if for some reason the sub-pressure is lost, yoke 22 prevents steel belt 1 in the upper press portion from falling down and the balls from flowing out of the press.

Ball passages 11 and 12 and the lateral ducts 17 connected thereto as well as the source of negative pressure may be partly or completely filled with lubricant, preferably oil.

In most presses the board material must be exposed to high temperature heat at the same time as it is being pressed. In a press according to the invention this may be brought about by heating press plates 9 in about the same manner as in conventional multiple opening presses, i.e. by means of electrical resistor elements or ducts for hot steam, hot water or hot oil provided within the press plates. The heat then is conducted in ball passage 11 on one hand through the balls and on the other hand through the air surrounding them to the press belt and through the latter to the board material. Additional heat may be supplied by heating the air in the negative pressure source and forcing the heated air to circulate through ball passage 11 by means of a pump. A still better heat input is obtained if the air in spaces 11, 12 and 17 is replaced by oil that is heated in connection with the source of negative pressure.

Finally, the steel belt may be heated before it enters the press slot.

If in any place the width of return passage 12 is reduced the speed of the balls will increase correspondingly.

Preferably the press belt is an endless steel belt, and the diameter of the balls preferably is 2–5 times the thickness of the steel belt. If, for instance, the thickness of the steel belt is 1.5 mm the ball diameter preferably is 3–7 mm. The maximum size of the balls is limited in the first place by the steel belt beginning to bend at a high surface pressure and with an increased distance between the points of support. On the other hand, the size of the balls has no effect on the degree of their indenting the steel belt or the supporting surface and hence not on the rolling effect thereon. When the slot space according to the invention is filled with balls to its maximum capacity, the steel belt and the steel supporting surface without any risk of a rolling effect will stand a press surface pressure that is more than sufficient for normal pressing requirements. However, when required, substantially higher press surface pressures may be permitted if already when made the steel belt and/or the supporting surface are provided with longitudinal pre-rolled grooves corresponding to the diameter and rolling paths of the balls.

As is evident to the expert, the embodiment of the invention described may be modified and varied in many ways within the scope of the invention. Thus, the moving surfaces defining the upper and lower press slots may differ mutually quite considerably. From the point of view of the invention it is essential that at any rate one of the surfaces is constituted by a press belt. This does not necessarily have to be a steel belt but it is of essential importance that the face of the belt against which the balls roll is of a sufficiently hard material. The other face of the belt may be of some other material that is more suitable with respect to the board material to be pressed.

A substantial improvement as regards the practical use of the press is obtained by subjecting ball passages 11 and 12 to negative pressure as shown in FIG. 2*a*.

I claim:

1. A press for the continuous production of boards, in which a board material (6) to be pressed is fed into a press slot between two movable surfaces of which at least one is provided by an endless press belt (1) at the press slot resting on a supporting surface (10) in such a manner that it cannot increase its distance from the opposed moving surface, wherein each press belt (1) and the supporting surface (10) associated therewith define between themselves a passage (11) filled to a maximum capacity thereof with bearing balls and merging into a return passage (12), the balls, when the press is operating, carrying out a complete orbital motion.

2. The press of claim 1, wherein the ball passages (11, 12) are connected to a source of negative pressure by means of lateral passages (17).

3. The press of claim 2, wherein the ball passages (11, 12), the lateral passages (17) and the source of negative pressure are at least partially filled with lubricant, preferably oil.

4. The press of claim 3, wherein the oil is heated.

5. The press of any preceding claim, further comprising a pair of lateral rails (16) disposed on opposite sides of the return passage (12), and means for urging said rails towards each other to thereby ensure the filling of the passages with balls.

6. The press of claims 1, 2, 3 or 4, wherein the diameter of the balls is 2–5 times the thickness of the steel belt (1).

* * * * *